US011239604B2

(12) United States Patent
Barlemont

(10) Patent No.: US 11,239,604 B2
(45) Date of Patent: Feb. 1, 2022

(54) CONNECTOR DETACHABLY CONNECTABLE TO A CONNECTION OBJECT

(71) Applicant: Hirose Electric Co., Ltd., Kanagawa (JP)

(72) Inventor: Arnaud Barlemont, Kanagawa (JP)

(73) Assignee: HIROSE ELECTRIC CO., LTD., Yokohama (JP)

( * ) Notice: Subject to any disclaimer, the term of this patent is extended or adjusted under 35 U.S.C. 154(b) by 0 days.

(21) Appl. No.: 17/036,264

(22) Filed: Sep. 29, 2020

(65) Prior Publication Data

US 2021/0119382 A1 Apr. 22, 2021

(30) Foreign Application Priority Data

Oct. 16, 2019 (EP) ..... 19306345

(51) Int. Cl.
*H01R 13/635* (2006.01)
*H01R 13/639* (2006.01)

(52) U.S. Cl.
CPC ..... *H01R 13/635* (2013.01); *H01R 13/639* (2013.01)

(58) Field of Classification Search
CPC ..... H01R 13/635; H01R 13/639
See application file for complete search history.

(56) References Cited

U.S. PATENT DOCUMENTS 6,956,745 B2 * 10/2005 Kerrigan ..... H05K 7/1487 312/223.1
10,283,908 B1 * 5/2019 Simmons ..... H01R 13/5816
10,741,939 B1 * 8/2020 Nikolopoulos ..... H01R 4/70
2019/0244065 A1 * 8/2019 Chuang ..... G06K 7/0021

FOREIGN PATENT DOCUMENTS

EP 3 422 488 A1 1/2019
WO 2007-09798 A1 4/2007

OTHER PUBLICATIONS

European Search Report, dated Apr. 2, 2020, 8 pages.

* cited by examiner

*Primary Examiner* — Tho D Ta
(74) *Attorney, Agent, or Firm* — Rankin, Hill & Clark LLP

(57) ABSTRACT

A connector is detachably connectable to a connection object. The connector includes a pair of locking members, each of which includes a locking latch configured to be engageable with the connection object to lock the connector to the connection object, the pair of locking members being configured to be actuatable in mutually opposite directions to a release position in which the respective locking latches are to be disengaged from the connection object. The connector further includes a single pushbutton externally accessible to be pressed in a first direction for actuating the pair of locking members to the release position, and a transfer means for transferring pressing force to be applied on the pushbutton to move one of the locking members in the first direction and the other of the locking members in a second direction which is opposite to the first direction.

5 Claims, 18 Drawing Sheets

CONNECTOR DETACHABLY CONNECTABLE TO A CONNECTION OBJECT

FIELD OF THE INVENTION

The present invention relates to a connector detachably connectable to a connection object.

BACKGROUND OF THE INVENTION

EP 3422488 A discloses a connector provided with a locking means, by which the connector can be detachably connected to a connection object. The locking means includes a pair of locking members engageable with corresponding through holes formed in the connection object. In order to disconnect the connector from the connection object, a user presses a pair of pushbuttons provided on mutually opposite sides of the connector, typically with his two fingers. As the pushbuttons are being pressed, the pushbuttons come in contact with the corresponding locking members, which results in deformation of the locking members to eventually disengage the locking members from the connection object.

Connectors provided with this type of locking means is useful because it is ensured that the connector is reliably kept connected to the connection object during use, while allowing easy detachment of the connector, whenever necessary.

The connector of EP 3422488 A, however, has limitation in terms of connectors arrangement because there needs a space around the pushbuttons in order for a user to place his fingers to press the pushbuttons. For example, if those connectors are arranged in two or more rows with the pushbuttons of the adjacent connectors facing each other, a sufficient space is required between the adjacent connectors. Also, a connector of this type may not be suitable when a pushbutton is directly placed on the floor or other walls because no or little space is available around the pushbutton.

In view of the above, the present invention aims to provide a solution to allow for flexible arrangement of connectors.

SUMMARY OF THE INVENTION

According to the invention, there is provided a connector as defined in appended claim 1 and the corresponding dependent claims.

Specifically, there is provided a connector detachably connectable to a connection object, the connector comprising a pair of locking members, each of which includes a locking latch configured to be engageable with the connection object to lock the connector to the connection object, the pair of locking members being configured to be actuatable in mutually opposite directions to a release position in which the respective locking latches are to be disengaged from the connection object. The connector further comprises: a single pushbutton externally accessible to be pressed in a first direction for actuating the pair of locking members to the release position; and a transfer means for transferring pressing force to be applied on the pushbutton to move one of the locking members in the first direction and the other of the locking members in a second direction which is opposite to the first direction.

The transfer means may comprise a rocking part configured to be rotatable.

The transfer means may comprise a hinge portion.

The transfer means may comprise a flexible portion in which the transfer means is elastically deformable.

The transfer means may be provided in a housing of the connector, the transfer means comprising a sliding part configured to be slidable in the first direction and the second direction on an inner surface of the housing.

The sliding part may be integrally formed with the pushbutton.

The housing may comprise guiding means for guiding the sliding part in the first and second direction.

According to the present invention, only a single pushbutton is required to move the pair of locking members to the respective release positions when the connector is to be detached from the connection object. It is thus only necessary to provide a space around the single pushbutton, making it possible to provide more freedom in arrangement of connectors.

BRIEF DESCRIPTION OF THE DRAWINGS

Embodiments of the invention will be described in further detail with reference to the accompanying drawings, in which.

DETAILED DESCRIPTION OF THE EMBODIMENTS OF THE INVENTION

Figure 1:
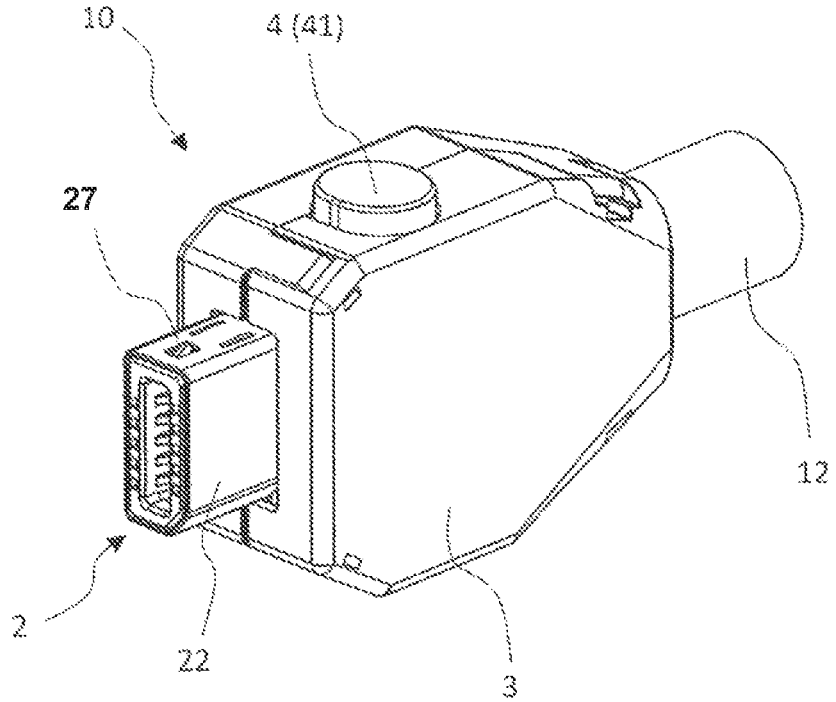
FIG. 1 is a perspective view showing a connector according to an embodiment.
Figure 2A:
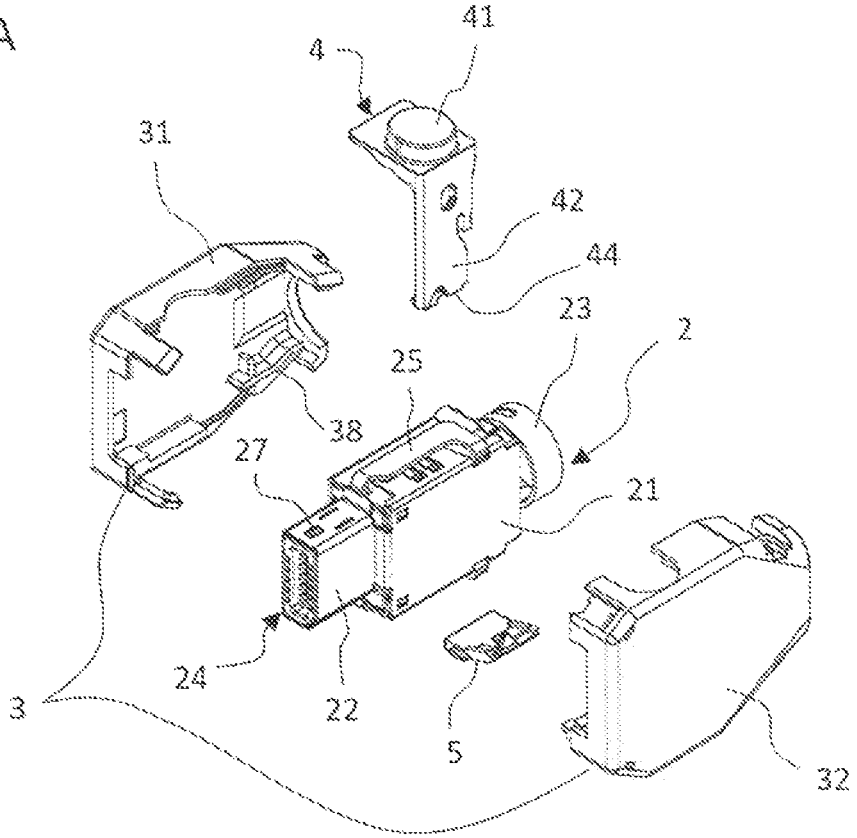
FIGS. 2A and 2B are exploded perspective views showing the connector according to the first embodiment from the opposite sides from each other.
Figure 2B:
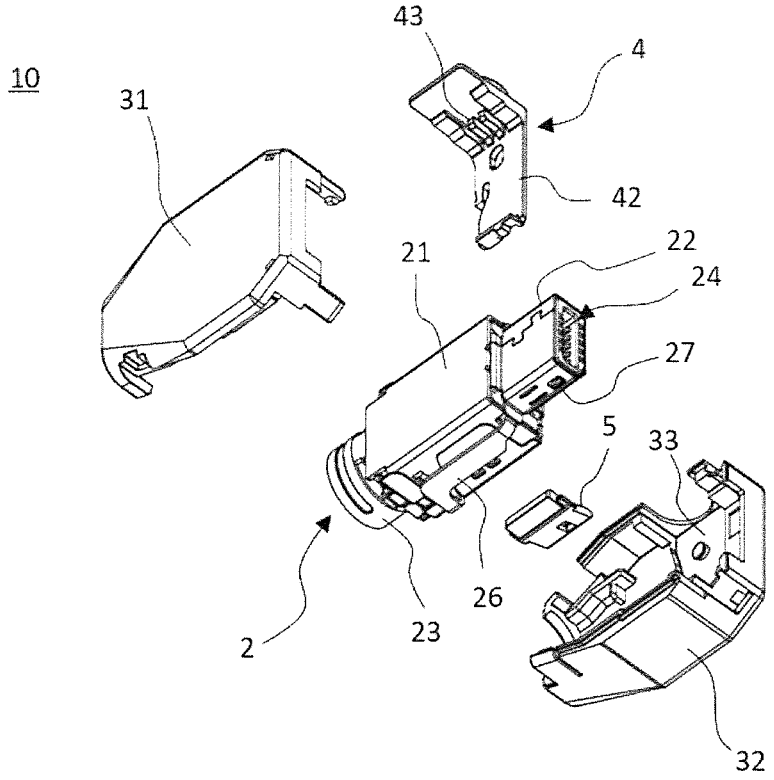

FIGS. 1 to 2B show a connector 10 according to the first embodiment. In the illustrated embodiment, the connector 10 is configured as a cable connector, to which a cable 12 can be connected as shown in FIG. 1. The connector 10 includes a connector module 2, a housing 3 and a pushbutton 4.

The connector module 2 is generally covered by the housing 3 serving as an insulator. The housing 3 is formed from a first housing part 31 and a second housing part 32 assembled together. The connector module 2 itself is generally in the form of a metal casing for protecting various electrical parts arranged inside. The connector module 2 is to be fitted to a connection object for establishing, for example, electrical or optical and mechanical connections between the connector 10 and the connection object.

The connector module 2 is provided with a locking means for locking the connector 10 to the connection object in order to prevent unintentional disconnection from the connection object.

The connector module 2 includes a main body 21, a connecting tip 22, and the cable receiver 23. The connecting tip 22 extends from the main body 21 on an opposite side from the cable receiver 23.

Figure 3:
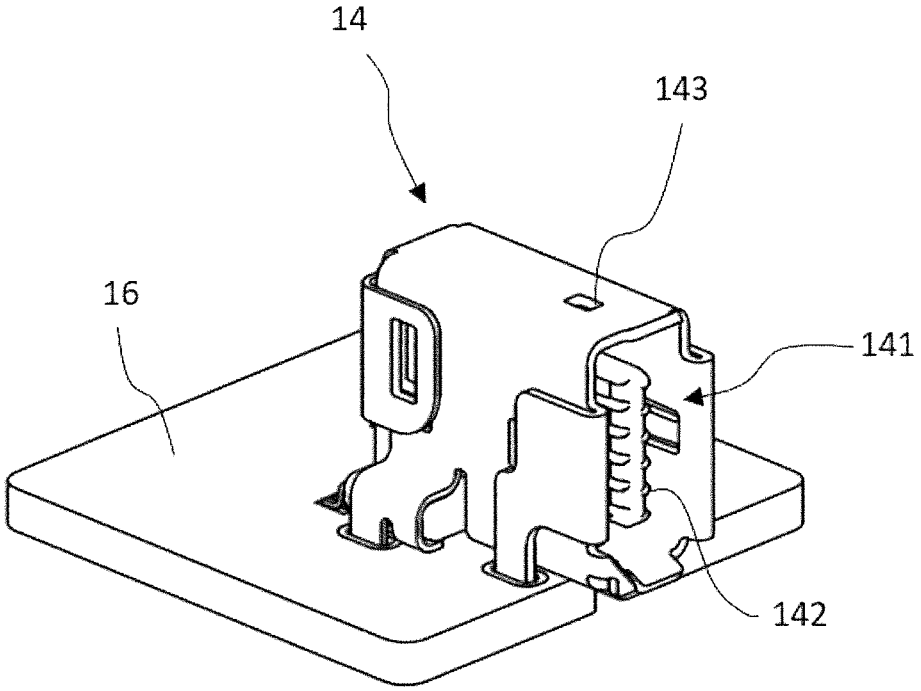
FIG. 3 is a perspective view showing a connection object, to which the connector of FIG. 1 can be connected.

An example of the connection object 14 is shown in FIG. 3. The connection object 14 may be, for example, configured as a board connector being mounted on a circuit board 16. The connection object 14 defines a convex portion 141 for receiving the connecting tip 22 of the connector 10. Contact elements 142 are provided in the convex portion 141. The contact elements 142 are to be received by a corresponding concave portion 24 of the connecting tip 22. Electrical or optical and connections can be established when the connecting tip 22 of the connector 10 is inserted and placed in position in the convex portion 141 of the connection object 14.

The connection object 14 also defines a locking opening 143 serving as a locking means in cooperation with a corresponding locking member 25 of the connector module 2. The locking opening 143 is formed in an outer layer of the connection object 14. Although not visible from FIG. 3, another locking opening is formed on the opposite side from the locking opening 143 to interact with a locking member 26 of the connector module 2.

In the illustrated embodiment, the connector 10 and the connection object 14 are illustrated as a cable connector and a board connector, respectively. The present invention is, however, not limited to those particular configurations. For example, the connector 10 may as well be configured as a board connector or any other known type of connectors. Likewise, the connection object 14 may be configured as a cable connector or any other known type of connectors.

Figure 4:
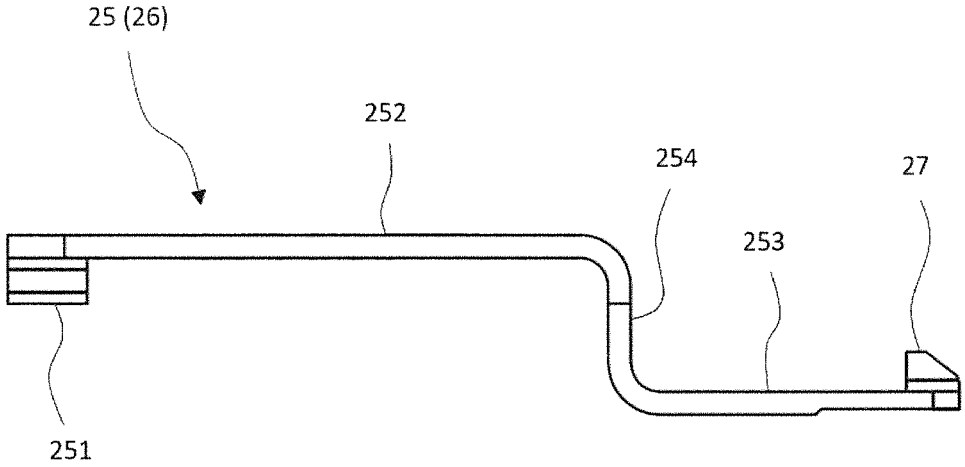
FIG. 4 shows a locking member of the connector.

Referring back to FIGS. 2A and 2B, the locking members 25 and 26 extend along mutually opposite sides of the connector module 2. FIG. 4 shows a side view of the locking member 25/26. Since the locking members 25 and 26 are identical to each other, the same explanation applies to either of the locking members. The locking member 25/26 is an elongated member having a base end 251 connected to the main body 21 of the connector module 2. The locking member 25/26 includes a main part 252 and a tip part 253 connected by a stepped part 254.

In an assembled state, the main part 252 extends from the base end 251 along the main body 21 of the connector module 2 at a distance from the main body 21. The tip part 253 extends along and inside the connecting tip 22. The tip part 253 is covered by the tip part 22 and not visible from the outside (see FIGS. 2A and 2B, for example). The stepped part 254 extends generally at a right angle relative to the main part 252 and the tip part 253.

The locking member 25/26 is provided with a locking latch 27 on the tip part 253. The locking latch 27 protrudes outwardly from the tip part 253. The locking latch 27 is configured to protrude from the connecting tip 22 through an opening and configured to be engageable with the connection object 14, in particular the locking opening 143. The locking latch 27 has a tapered shape toward a distal end in order to facilitate insertion of the connecting tip 22 into the convex portion 141 of the connection object 14.

The locking members 25 and 26 are preferably provided in such a way that the tip parts 253 of the locking members 25 and 26 are urged against corresponding inner surfaces of the connecting tip 22. Or in other words, the locking members 25 and 26 are urged to maintain a lock position at which the locking latches 27 are to be engaged with the locking opening 143.

The pushbutton 4 is configured to be externally accessible to be pressed by a user. As can be seen from FIG. 1, the pushbutton 4 includes an operation part 41 protruding from the housing 3.

Figure 5:
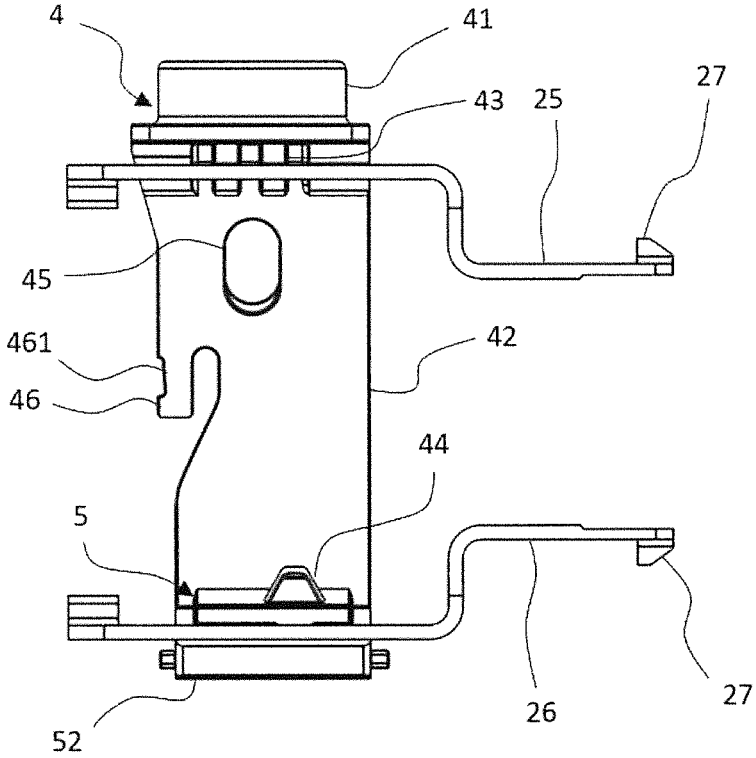
FIG. 5 shows a pushbutton, the locking members and the rocking part of the connector.
Figure 6:
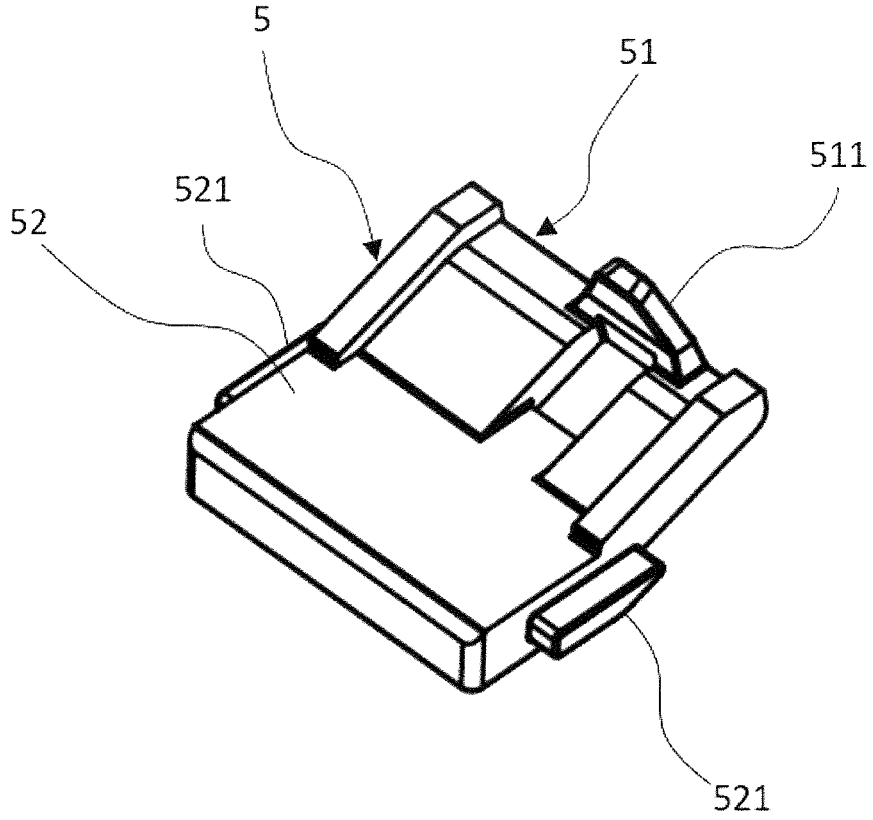
FIG. 6 shows a rocking part of the connector.
Figure 7A:
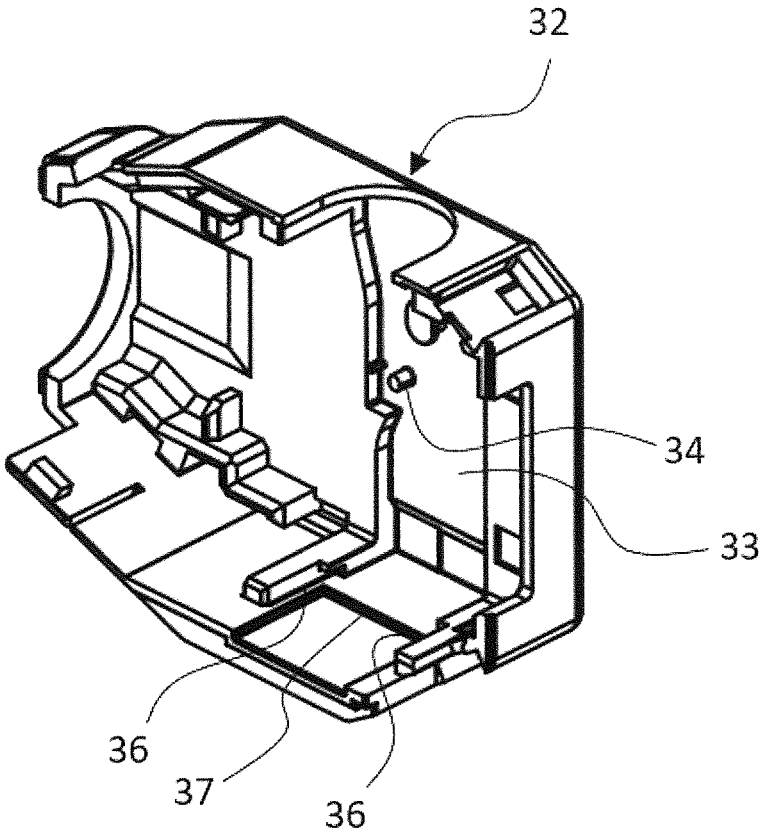
FIG. 7A shows a housing part with which the pushbutton is assembled.

Referring to FIG. 5, the pushbutton 4 also includes a sliding part 42, an acting part 43 and an abutment part 44. The sliding part 42 is configured to be slidable on an inner surface of the housing 3 in the same direction as the operation part 41 can be pressed (hereinafter may be referred to as "the pressing direction"). Corresponding to the sliding part 42, the second housing part 32 is formed with a thinner portion 33 for slidably supporting the sliding part 42 (see FIG. 7A, for example).

The acting part 43 is provided directly beneath the operation part 41 to face the locking member 25. The acting part 43 is configured to act on the locking member 25 for transferring pressing force applied onto the operation part 41 to the locking member 25 when the pushbutton 4 is being pressed down.

Figure 7B:
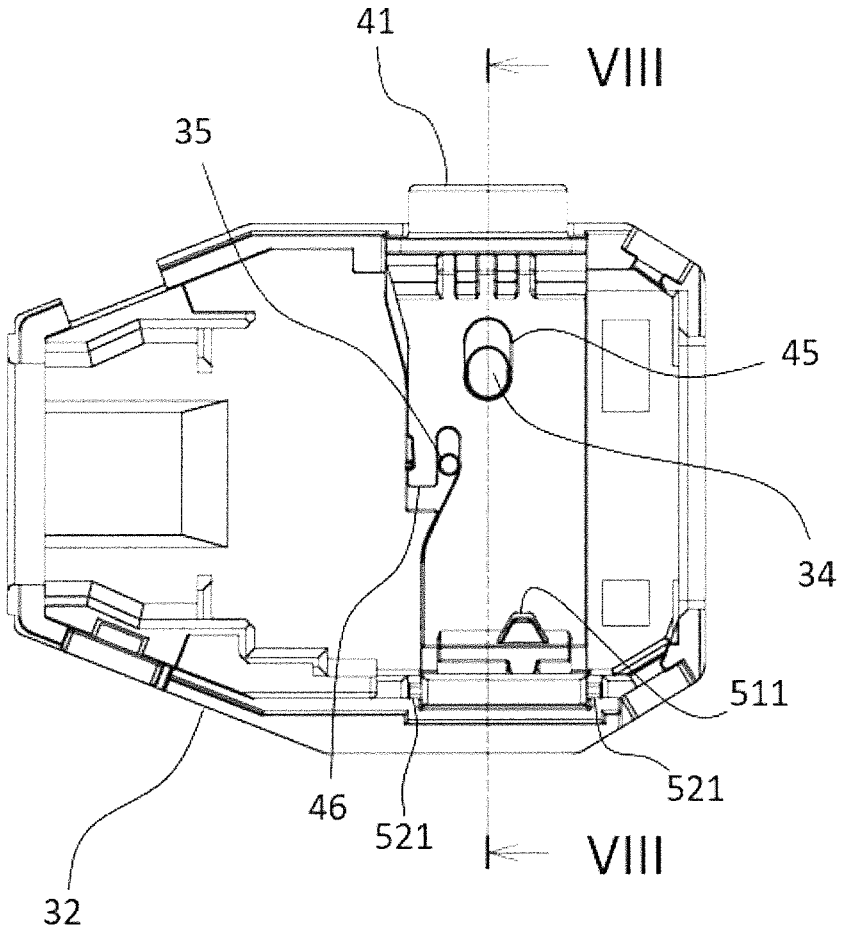
FIG. 7B shows the pushbutton and the rocking part of FIG. 5 together with the housing part.

The pushbutton 4 may be provided with a guiding and locking hole 45 and/or a guiding finger 46. As can be seen from FIG. 7B, the guiding hole 45 is configured to slidably receive a guiding peg 34 formed on the second housing part 32. The guiding finger 46 is configured to interact with another guiding peg 35 formed on the second housing part 32. The guiding finger 46 may also have a slanted portion 461 extending at an angle relative to the pressing direction to be slidably fitted to the second housing part 32. Those combinations of elements serve as a guiding means for guiding the pushbutton 4, or restricting movement of the pushbutton 4, in the pressing direction. The pushbutton 4 is also allowed to move in the direction opposite to the pressing direction, to return to its initial position when the pushing force stops applying the pushbutton 4.

Figure 8:
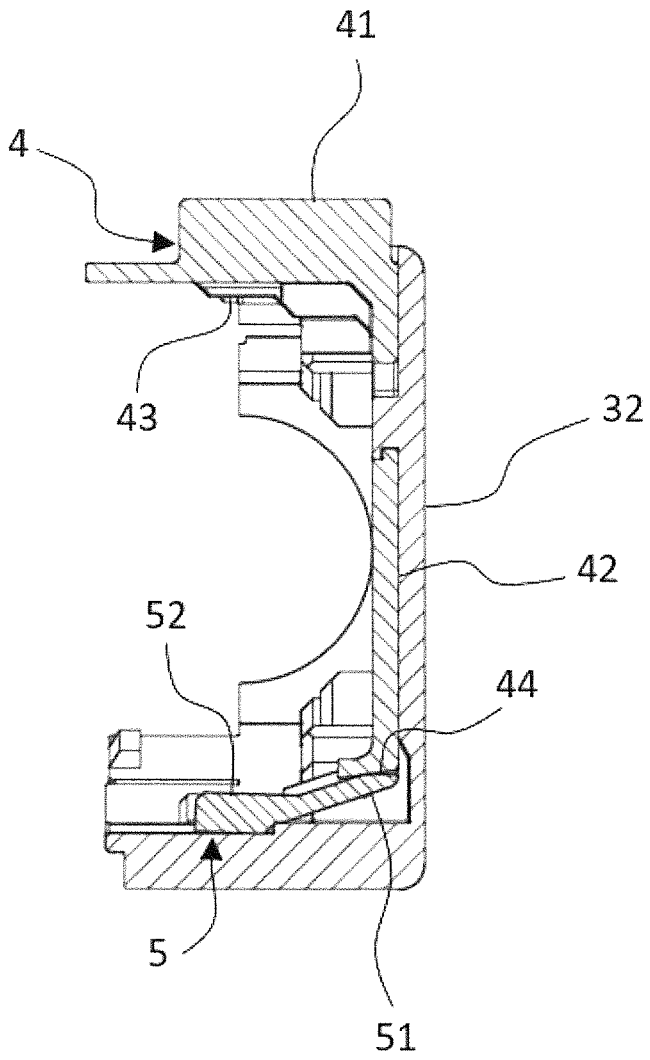
FIG. 8 is a sectional view showing the pushbutton and the rocking part.

As can be seen from FIG. 8, the abutment part 44 is provided to face a receive end 51 of the rocking part 5. The rocking part 5, which is formed separately from the pushbutton 4, is configured to receive over the receive end 51 the pressing force applied on the pushbutton 4 and transferred via the sliding part 42. The receive end 51 may be formed with a protrusion 511 to be received by a notch formed in the abutment part 44. Such a protrusion 511 may assist alignment between the pushbutton 4 and the rocking part 5 with respect to the pressing direction.

The rocking part 5 also includes an acting part 52 and side abutments 521 provided on opposite sides of the acting part 52. The acting part 52 is positioned to face the locking member 26 which is arranged on the opposite side from the locking member 25. The side abutments 521 are configured to come in contact with corresponding recessed portions 36 formed on the second housing part 32. Also, the acting part 52 is positioned by a limiting step 37 of the second housing part 32. Thanks to the combination of the side abutments 521, the recessed portions 36, the acting part 52 and the limiting step 37, the rocking part 5 can be assembled with the second housing part 32 by sliding on an inner surface of the second housing part 32.

Figure 9:
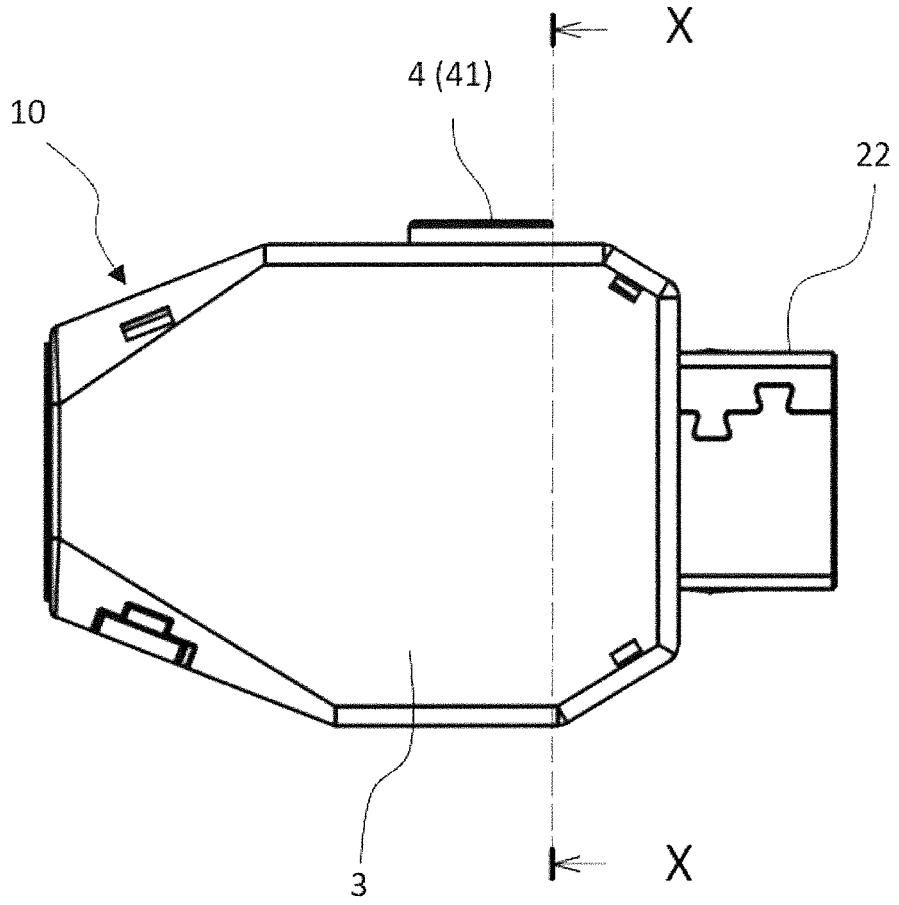
FIG. 9 is a side view showing the connector.
Figure 10A:
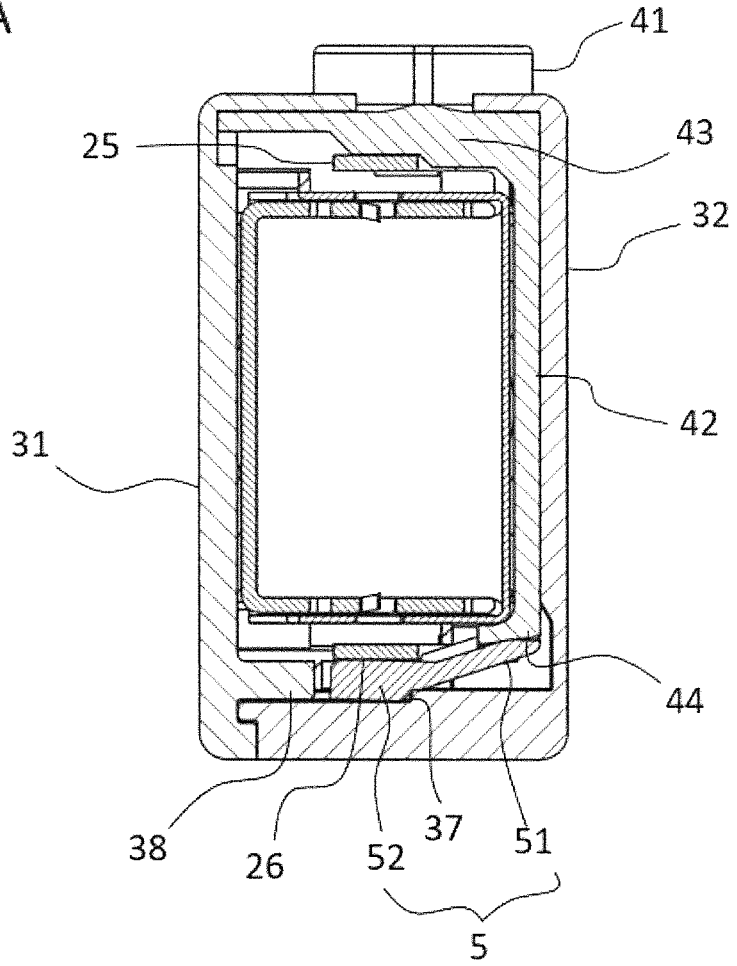
FIGS. 10A to 10C are sectional views taken along a line X-X of FIG. 9.
Figure 10B:
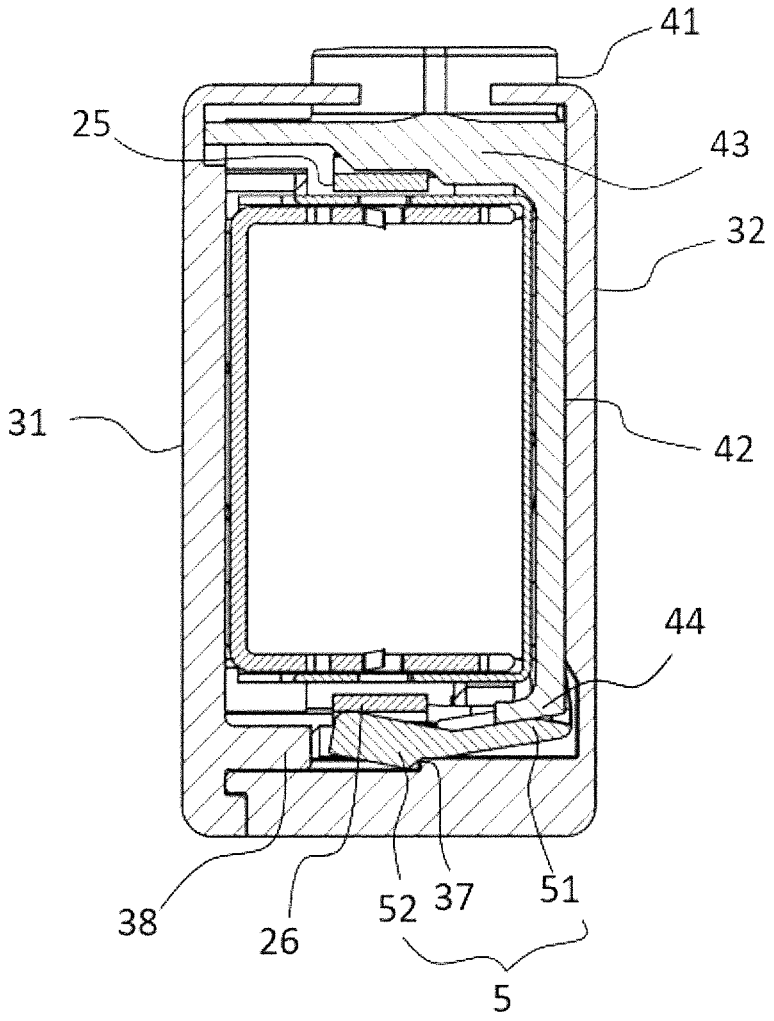
Figure 10C:
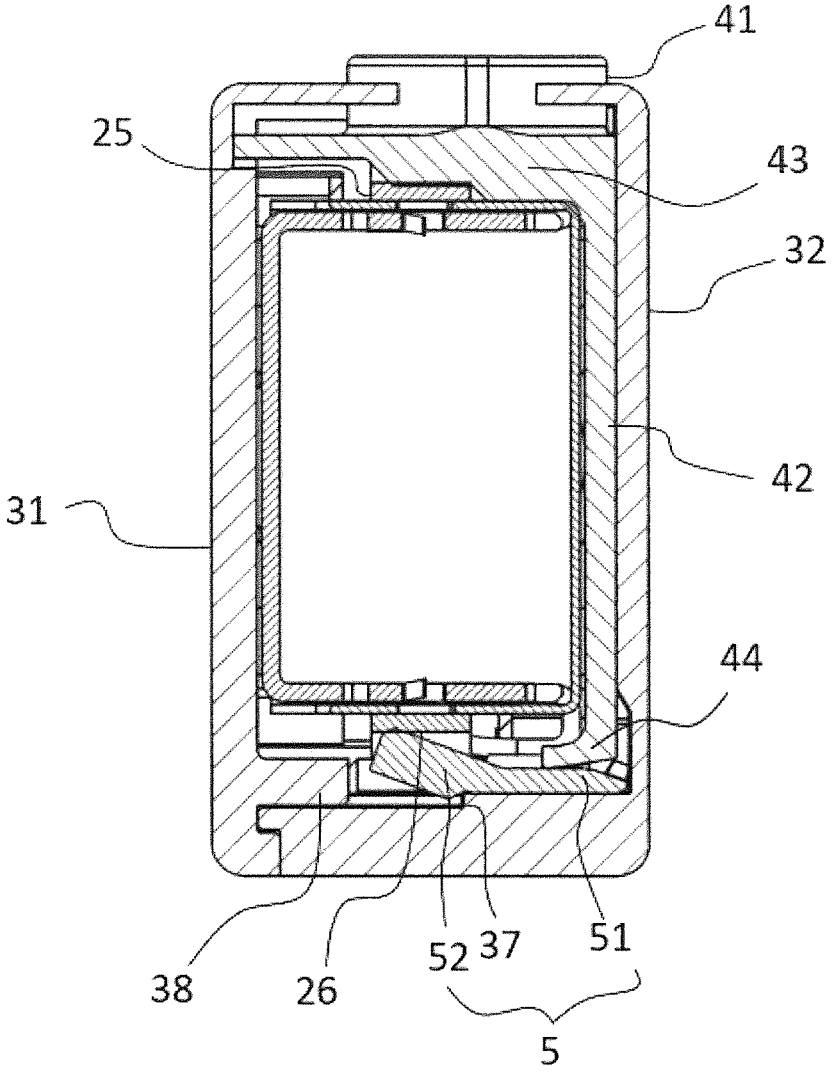

Referring to FIG. 10A to 10C, the process of moving the locking members 25 and 26 to the release positions will be explained. FIGS. 10A to 10C are respectively sectional views taken along a line X-X of FIG. 9.

FIG. 10A shows the state where no pressing force is applied onto the pushbutton 4. In this state, the locking members 25 and 26 are in the lock position, i.e. the locking latches 27 are engaged with the locking openings 143.

As shown in FIG. 10B, when the pushbutton 4 is pressed in the pressing direction, the acting part 43 of the pushbutton 4 is actuated to move the locking member 25 inwardly, i.e. also in the pressing direction. Also, the sliding part 42 slides on the second housing part 32 in the pressing direction, pushing down the receive end 51 of the rocking part 5. It is to be noted that translation of the rocking part 5 is prevented by the limiting step 37 of the second housing part 32 in combination with a limiting protrusion 38 protruding from an opposite inner surface of the first housing part 31.

Since the movement of the rocking part 5 is restricted by the combination of limiting step 37 and the limiting protrusion 38, the rocking part 5 rotates as the receive end 51 is actuated along the pressing direction. In this way, the movement of the pushbutton 4 in the pressing direction is transferred into the movement of the locking member 26 in the opposite direction of the pressing direction. In an embodiment, the rocking part 5 is formed to have the center of gravity in the acting part 52, rather than in the receive end 51. This configuration makes the rotation of the rocking part 5 stable, and as a result the pressing force on the receive end 51 can be reliably transferred to generally inward movement of the acting part 52.

When the pushbutton 4 is pressed further and the locking members 25 and 26 are actuated in the mutually opposite directions (see FIG. 10C), the locking latches 27 of the locking members 25 and 26 are disengaged from the locking openings 143. In this state, the connector 10 is unlocked from the connection object 14 and thus can be detached from the connection object 14 by pulling it away from the connection object 14.

According to the above-described connector 10, only the single pushbutton 4 is required to unlock from the connection object 14 the locking latches 27 provided on the mutually opposite sides of the connector 10. Thanks to this configuration, no space has to be reserved around the opposite side of the operation part 41. It is advantageous, in particular when a space available for installing the connector 10 is limited. Further, since a user is only required to press the single pushbutton 4 in order to unlock the connection, the detachment operation can be facilitated.

Figure 11:
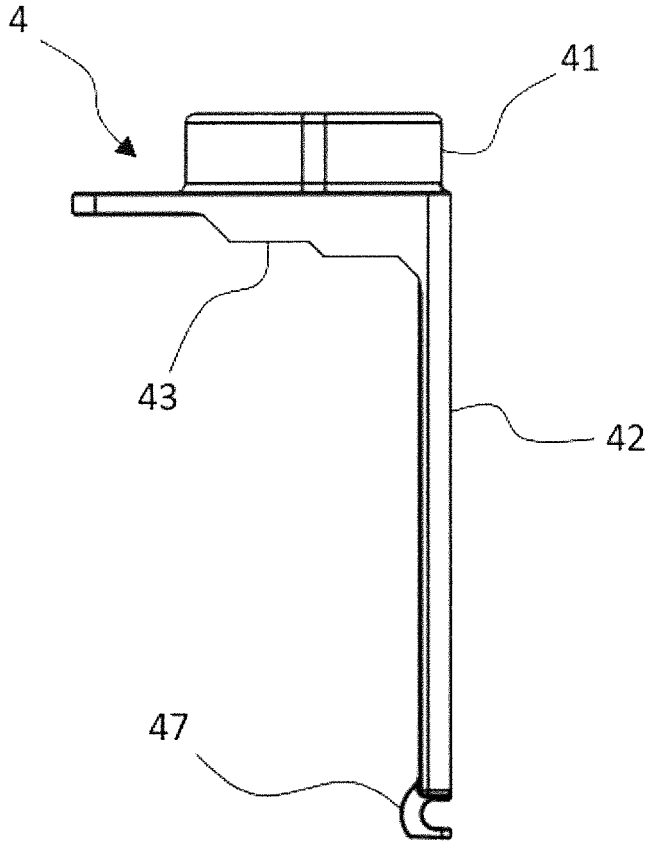
FIG. 11 shows a pushbutton according to the second embodiment.
Figure 13A:
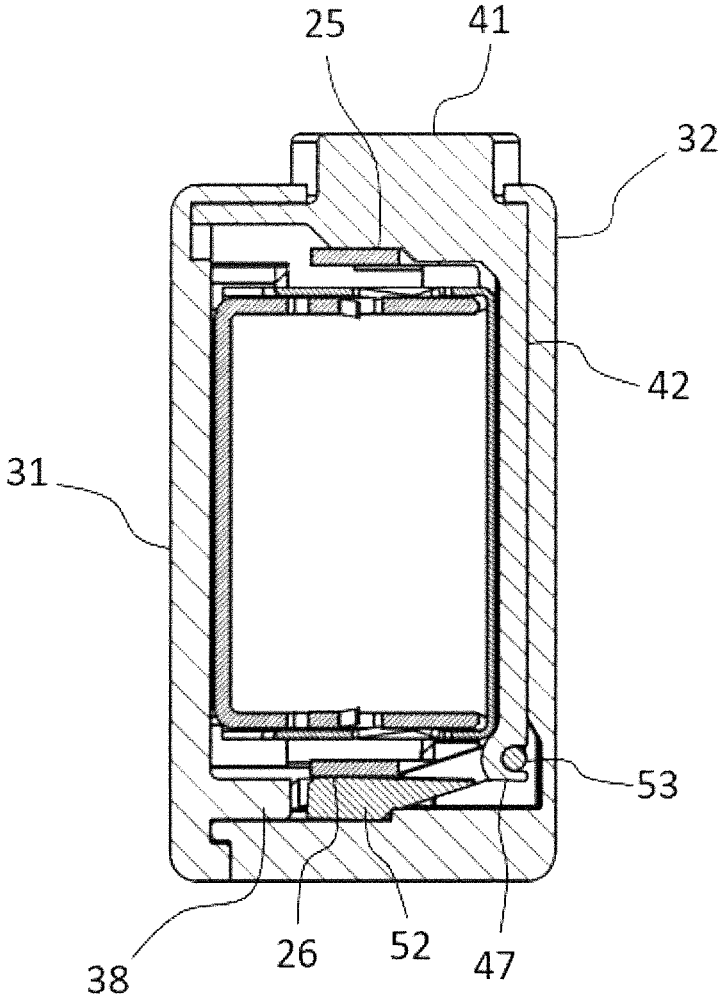
FIGS. 13A to 13C are sectional views of the connector according to the second embodiment, corresponding to FIGS. 10A to 10C, respectively.
Figure 13B:
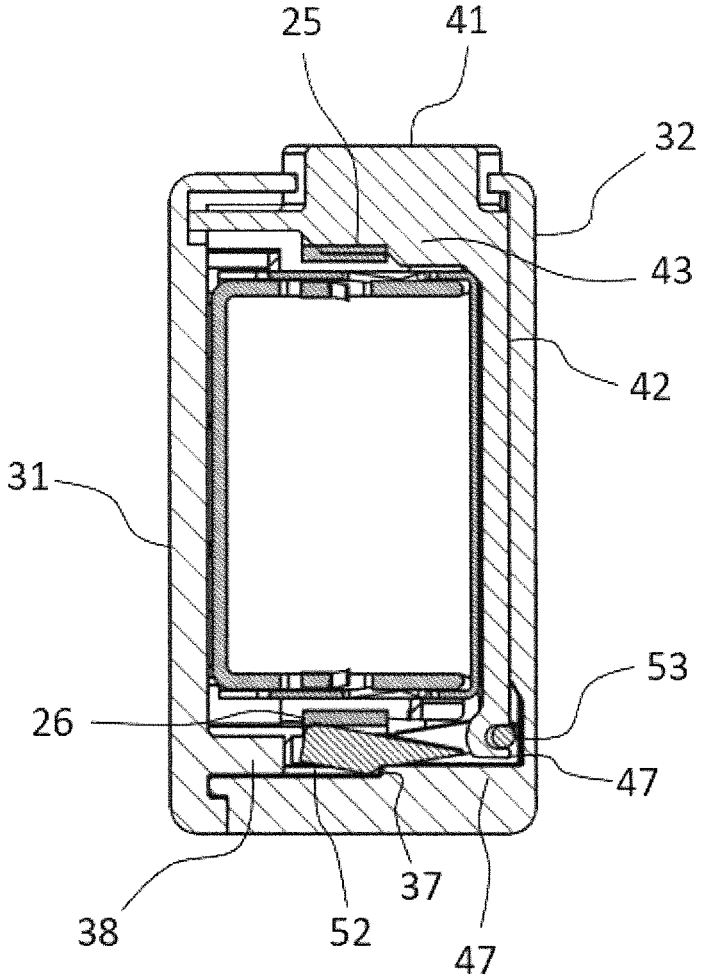
Figure 13C:
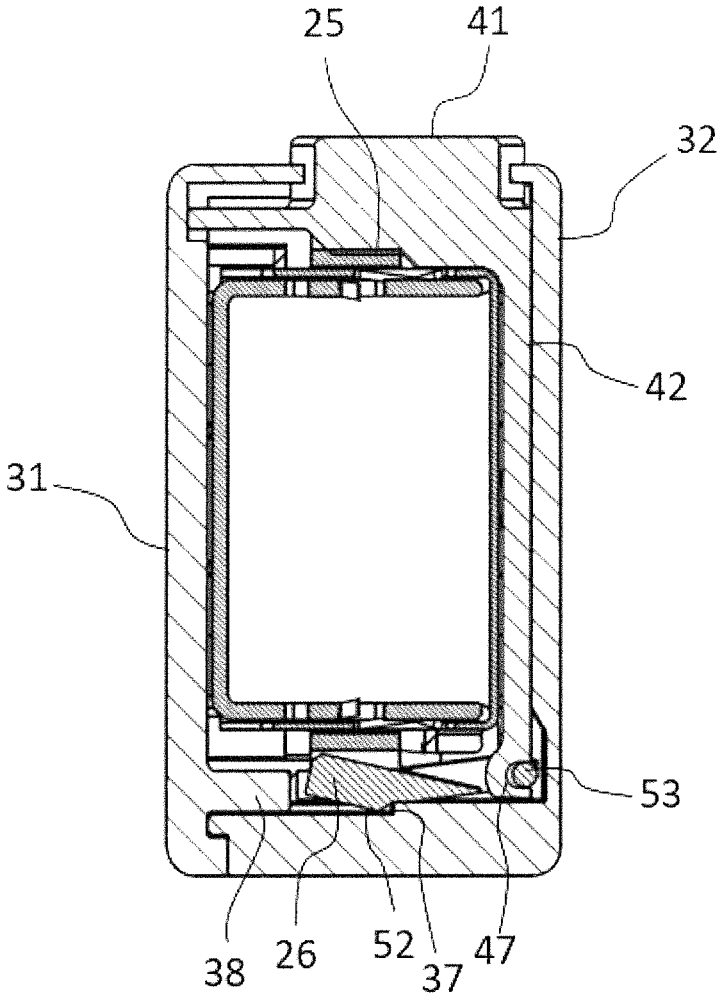

Referring to FIGS. 11 and 13C, the connector 10 according to the second embodiment will be explained.

The connector in this embodiment differs from the above described embodiment in respect of the configuration of the pushbutton 4 and the rocking part 5. Common features that have already been described in relation to the above embodiment will not be explained again.

FIG. 11 shows a pushbutton 4 according to this embodiment. The pushbutton 4 includes a shaft receiver 47 provided at the end of the sliding part 42, in place of the abutment part 44.

Figure 12:
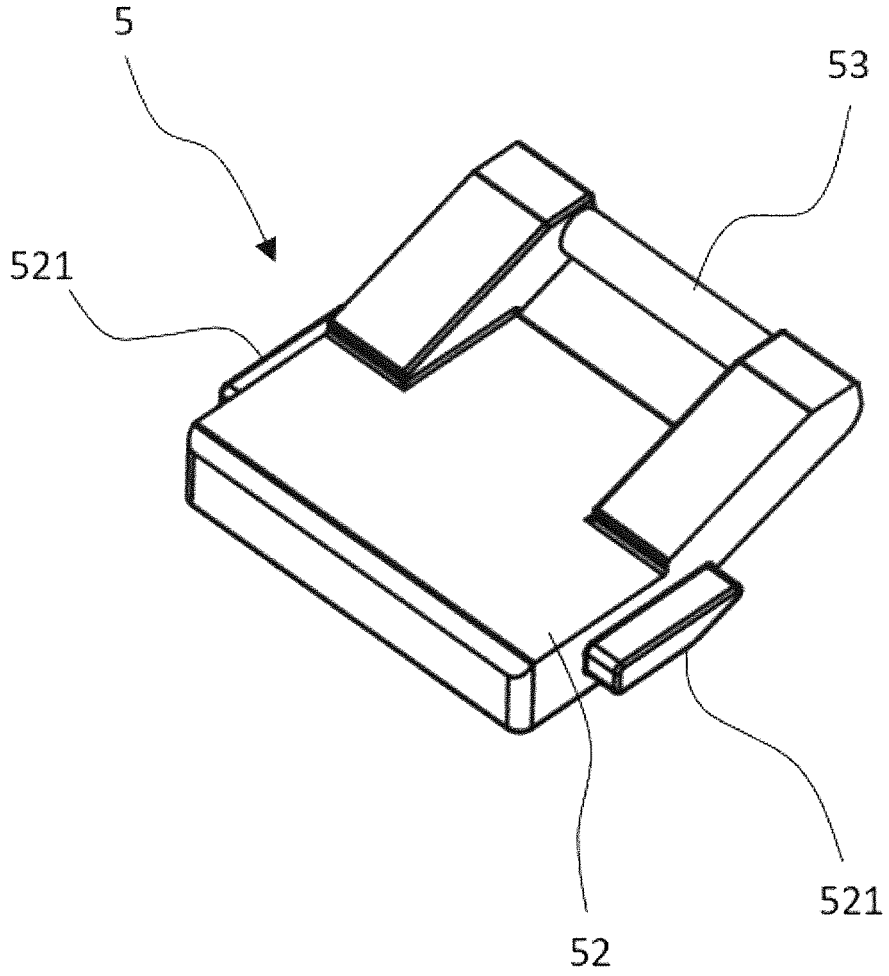
FIG. 12 shows a rocking part according to the second embodiment.

Referring to FIG. 12, the rocking part 5 includes a shaft 53 in place of the receive end 51. As shown in FIG. 13A, the shaft 53 is received by the shaft receiver 47 of the pushbutton 4 to form a hinge portion around which the rocking part 5 is rotatable.

As the pushbutton 4 is being pressed (FIG. 13B), the acting part 43 of the pushbutton 4 is actuated to move the locking member 25 inwardly or in the pressing direction, while the sliding part 42 slides on the second housing part 32 in the pressing direction. The shaft receiver 47 as well as the shaft 53 is also actuated in the pressing direction. Since the movement of the rocking part 5 is restricted by the limiting step 37 and the limiting protrusion 38 of the housing 3, the rocking part 5 rotates as the pushbutton 4 is dispositioned further in the pressing direction, thereby moving the locking member 26 inwardly or in the opposite direction of the pressing direction.

Therefore, according to the second embodiment, the same technical advantages can be achieved as the first embodiment. Namely, only the single pushbutton 4 is required to disengage the connector 10 from the connection object 14. Thanks to this configuration, no space has to be reserved around the opposite side of the operation part 41. Further, the detachment operation is facilitated.

Figure 14:
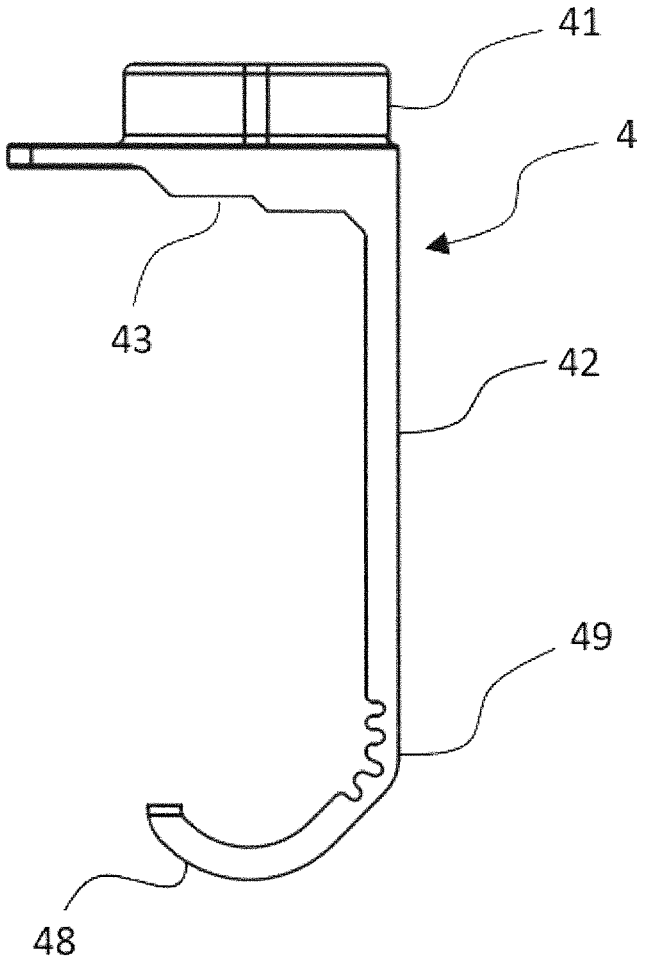
FIG. 14 shows a pushbutton according to the third embodiment.
Figure 15:
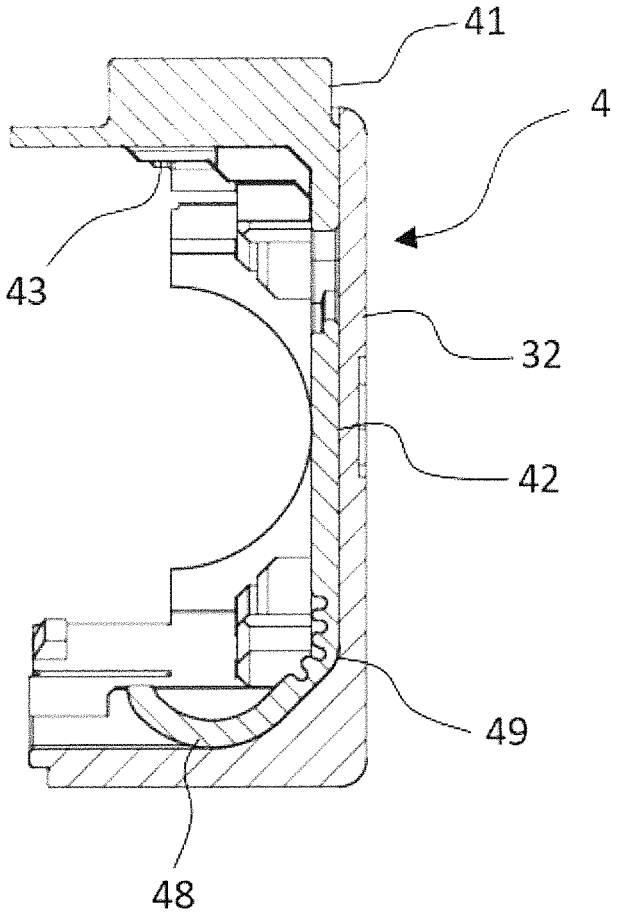
FIG. 15 shows the pushbutton of FIG. 14 assembled with a housing part, corresponding to FIG. 8.

FIGS. 14 and 15 show a pushbutton 4 according to the third embodiment. The pushbutton 4 has a different configuration from those of the first and second embodiments in that there is no separate element corresponding to the rocking part 5. In this embodiment, the pushbutton 4 includes at its distal end a curved acting part 48 connected to the sliding part 42 by a flexible part 49. The flexible part 49 is provided with a plurality of notches so as to be easily elastically deformable.

In the same way as the first and second embodiments, the movement of the curved acting part 48 is restricted. Therefore, as the sliding part 42 is actuated in the pressing direction upon the operation part 41 being pressed by a user, the curved acting part 48 is moved generally inwardly as a result of elastic deformation of the flexible part 49, thereby moving the locking member 26 to the release position.

Similarly to the first and second embodiments, only the single pushbutton 4 is required to disengage the connector 10 from the connection object 14. Thus, no space has to be provided around the opposite side of the operation part 41. Further, the detachment operation is facilitated.

The invention claimed is:

1. A connector detachably connectable to a connection object, the connector comprising:

a pair of locking members, each of which includes a locking latch configured to be engageable with the connection object to lock the connector to the connection object, the pair of locking members being configured to be actuatable in mutually opposite directions to a release position in which the respective locking latches are to be disengaged from the connection object;

a single pushbutton externally accessible to be pressed in a first direction for actuating the pair of locking members to the release position; and a transfer means for transferring pressing force to be applied on the pushbutton to move one of the locking members in the first direction and the other of the locking members in a second direction which is opposite to the first direction, wherein the transfer means comprises a rocking part configured to be rotatable.

2. A connector detachably connectable to a connection object, the connector comprising:

a pair of locking members, each of which includes a locking latch configured to be engageable with the connection object to lock the connector to the connection object, the pair of locking members being configured to be actuatable in mutually opposite directions to a release position in which the respective locking latches are to be disengaged from the connection object;

a single pushbutton externally accessible to be pressed in a first direction for actuating the pair of locking members to the release position; and a transfer means for transferring pressing force to be applied on the pushbutton to move one of the locking members in the first direction and the other of the locking members in a second direction which is opposite to the first direction, wherein the transfer means comprises a hinge portion.

3. A connector detachably connectable to a connection object, the connector comprising:

a pair of locking members, each of which includes a locking latch configured to be engageable with the connection object to lock the connector to the connection object, the pair of locking members being configured to be actuatable in mutually opposite directions to a release position in which the respective locking latches are to be disengaged from the connection object;

a single pushbutton externally accessible to be pressed in a first direction for actuating the pair of locking members to the release position; and a transfer means for transferring pressing force to be applied on the pushbutton to move one of the locking members in the first direction and the other of the locking members in a second direction which is opposite to the first direction, wherein the transfer means is provided in a housing of the connector, the transfer means comprising a sliding part configured to be slidable in the first direction and the second direction on an inner surface of the housing.

4. The connector according to claim 3, wherein the sliding part is integrally formed with the pushbutton.

5. The connector according to claim 3, wherein the housing comprises guiding means for guiding the sliding part in the first direction and the second direction.

* * * * *